US006742351B2

(12) United States Patent
Kim et al.

(10) Patent No.: US 6,742,351 B2
(45) Date of Patent: Jun. 1, 2004

(54) ICE MAKING MACHINE

(75) Inventors: Oh-bok Kim, Gwangju (KR); Hideo Nakajo, 1186-1, Janggi-dong, Kimpo-city, Gyunggi-do (KR)

(73) Assignees: Samsung Gwangju Electronics Co., Ltd., Gwangju (KR); Hideo Nakajo, Kimpo (KR)

( * ) Notice: Subject to any disclaimer, the term of this patent is extended or adjusted under 35 U.S.C. 154(b) by 9 days.

(21) Appl. No.: 10/412,041

(22) Filed: Apr. 11, 2003

(65) Prior Publication Data

US 2004/0083753 A1 May 6, 2004

(30) Foreign Application Priority Data

Oct. 31, 2002 (KR) ..... 2002-66740

(51) Int. Cl.[7] ..... F25C 5/10
(52) U.S. Cl. ..... 62/352; 62/353
(58) Field of Search ..... 62/345, 352, 353, 62/544, 138

(56) References Cited

U.S. PATENT DOCUMENTS 3,418,823 A * 12/1968 Salibeni ..... 62/138
3,791,166 A * 2/1974 Maleck ..... 62/138
4,199,956 A * 4/1980 Lunde ..... 62/138
4,207,750 A * 6/1980 Simkens ..... 62/138
5,035,118 A * 7/1991 Hara ..... 62/126
5,425,243 A * 6/1995 Sanuki et al. ..... 62/138
5,786,004 A * 7/1998 Yamauchi ..... 425/408
5,845,513 A * 12/1998 Fornasari ..... 62/353

FOREIGN PATENT DOCUMENTS

EP 0580952 A1 * 2/1994
EP 0580950 a1 * 2/1994
JP 09257347 A * 10/1997

* cited by examiner

*Primary Examiner*—William E. Tapolcai
*Assistant Examiner*—Mohammad M. Ali
(74) *Attorney, Agent, or Firm*—Ladas & Parry

(57) ABSTRACT

An ice-making machine comprises a housing, an evaporator connected to a freezing system, a base frame having a plurality of freezing cells for receiving water to be frozen, a freezing base plate on which the evaporator is disposed, the freezing base plate having a lower surface and freezing fingers formed thereon to be dipped into the water received by the freezing cells, and an air-removing means rocking the base frame to remove air bubbles from the water to be frozen. The air-removing means comprises a supporting frame for movably supporting the base frame and enabling it to rock upward and downward, a spring interposed between the base frame and the supporting frame, and a pressing means for repeatedly pressing the base frame, and the base frame being capable of rocking upward and downward due to the elastic recovering force of the spring and the pressure of the pressing means so that the water in the freezing cells are applied to the freezing fingers repeatedly.

7 Claims, 7 Drawing Sheets

ICE MAKING MACHINE

BACKGROUND OF THE INVENTION

1. Field of the Invention

The present invention relates generally to an ice-making machine, and more particularly, to an ice-making machine reducing ice making time and reducing the amount of water to be frozen from being wasted.

2. Description of the Prior Art

An ice-making machine is used for freezing water to form pieces of ice. One proposal is for an ice-making machine capable of preventing opacification, which occurs as air bubbles inside the water are frozen. FIGS. 1 through 3 are views showing a conventional ice-making machine, such as that disclosed in the U.S. Pat. No. 5,425,243.

As shown in FIGS. 1 through 3, a conventional ice-making machine includes a housing 10, a freezing unit 20, an air-removing means 30, and a detecting means 40 for detecting completion of the ice formation operation.

The housing 10 has an ice bin 11 for storing therein ice pieces formed in the freezing unit 20. Under the ice bin 11 are disposed a compressor 12 and a condenser 13, together comprising a freezing system.

As shown in FIG. 2, the freezing unit 20 includes a water tray 21, a freezing base plate 22 having a lower surface, and an evaporator 23. The water tray 21 is filled with the water to be frozen. A plurality of freezing fingers 24 are formed on the lower surface of the freezing base plate 22 to be dipped into the water in the water tray 21. At a side of the water tray 21 is provided a pivoting means 25 to discharge unfrozen water in the water tray 21 by tilting the water tray 21. The evaporator 23 is disposed on the upper surface of the freezing base plate 22 and is connected to a freezing system 12,13. As the refrigerant flows inside the evaporator 23, the freezing base plate 22 and the freezing fingers 24 are cooled utilizing heat exchange of the refrigerant.

The air-removing means 30 removes the air bubbles inside the water to be frozen, thereby preventing opacification from occurring during ice formation. The air-removing means 30 includes a rocking plate 31 vertically rocking inside the water tray 21 and a rocking motor 32 for driving the rocking plate 31. An engagement piece 33 disposed adjacent the rocking motor 32 pushes an engagement pin 34 upwardly of the rocking plate 31 to thereby move the rocking plate 31. Due to the rocking movement of the rocking plate 31, the air bubbles float upwardly and outside the water and thus are removed from the frozen ice pieces.

The detecting means 40 for detecting completion of the ice forming operation, as shown in FIG. 3, includes a forefinger switch 41, on which a lever 42 is disposed, and an actuation piece 44, disposed on a metal fitting 43 to which the rocking motor 32 is attached. When the rocking plate 31 collides with the ice pieces being gradually formed around the freezing fingers 24, the shock of the rocking plate 31 is transferred to the rocking motor 32 through the engagement piece 33. At this time, the metal fitting 43 is rotated on a supporting pivot shaft 45, so that the actuation piece 44, disposed at the metal fitting 43, presses the lever 42 to thus operate the forefinger switch 41.

The conventional ice-making machine further includes a water supply pipe 14, a pivotal shaft 26, a water chute 27, and a water collecting section 15, all of which are not further described herein as they are known in the conventional devices.

Hereinafter, the operation of the conventional ice-making machine is described.

When water to be frozen is supplied to the water tray 21 through the water supply pipe 14, to thus immerse the freezing fingers 24 dipped in the water, the water starts to be frozen around the freezing fingers 24 that are cooled at the temperature of 0° C. or lower by the heat exchange of the refrigerant flowing inside the evaporator 23. At the same time, the rocking motor 32 is activated to vertically rock the rocking plate 31 immersed in the water. Accordingly, the water is vertically rocked and thus the air bubbles inside the water are removed by floating upwardly. As a result, clear ice pieces are formed around the freezing fingers 24.

The ice pieces are gradually formed around the freezing fingers 24 to have a predetermined size, and the rocking plate 31 collides with the ice pieces so that the shock of the rocking plate 31 is transferred to the rocking motor 32 via the engagement piece 33. At this time, the metal fitting 43 to which the rocking motor 32 is attached is rotated on the supporting shaft 45 in a clockwise direction so that the actuation piece 44 presses the lever 42 of the forefinger switch 41. Accordingly, the time of completion of the ice forming operation is detected. When the ice formation is completed, the rocking plate 31 stops being rocked, hot gas is discharged from the compressor 12 and is supplied directly to the evaporator 23 without passing through the condenser 13 to temporarily heat the freezing fingers 24, and the water tray 21 pivots on the pivotal shaft 26 by the pivoting means 25 to thus be tilted. Accordingly, the formed ice pieces are separated from the freezing fingers 24 and are dropped into the ice bin 11. The unfrozen water that remains in the water tray 21 is guided by the water chute 27 and is discharged to the water collecting section 15.

Such conventional ice-making machines require an amount of water exceeding what is actually to be frozen as the water tray is designed to hold more than the amount of water necessary to make ice pieces, thereby wasting a lot of water.

Moreover, since the freezing fingers 24 cool not only the water around the freezing fingers 24 but also cool all of the water in the water tray 21, excessive energy is consumed and the growth rate of the ice pieces formed around the freezing fingers 24 is unnecessarily reduced.

SUMMARY OF THE INVENTION

The present invention has been developed in order to solve the above problems of the prior, art conventional ice-making machines. Accordingly, an object of the present invention is to provide an ice-making machine reducing the amount of water to be frozen that is cooled by supplying a predetermined amount of water into a plurality of freezing chambers having a predetermined size, and shortening the time required to form ice pieces by increasing the freezing rate.

The above object is achieved by providing an ice-making machine comprising a housing, an evaporator connected to a freezing system, a base frame having a plurality of freezing cells for receiving water to be frozen, a freezing base plate on which the evaporator is disposed, the freezing base plate having a lower surface and freezing fingers formed thereon to be dipped into the water supplied to the freezing cells, and an air-removing means for rocking the base frame to remove air bubbles from the water to be frozen.

Preferably, the air-removing means comprises a supporting frame for movably supporting the base frame and enabling it to rock upward and downward, a spring interposed between the base frame and the supporting frame, and a pressing means for repeatedly pressing the base frame, and the base frame being capable of rocking upward and downward due to the elastic recovering force of the spring and the pressure of the pressing means so that the water in the freezing cells are applied to the freezing fingers repeatedly.

Also, it is preferred that the pressing means comprises a cam disposed for contact with the base frame and a cam motor for rotating the cam.

Also, it is preferred that the base frame has a sliding bar for being inserted into a sliding hole formed in the supporting frame.

Also, the ice making machine further comprises a detecting means for detecting completion of the ice forming operation by detecting a variation in the distance within which the base frame is being rocked, the variation depending on the sizes of the ice pieces formed around the freezing fingers.

Preferably, the detecting means comprises a magnetic sensor for sensing a variation in the magnetic force caused by the rocking base frame to detect when the ice pieces formed around the freezing fingers reach the predetermined sizes.

Preferably, a blocking segment moving vertically between both sensing portions of the magnetic sensor is movably provided at a side of the supporting frame, and the magnetic sensor is disposed at the base frame for detecting the variation in the magnetic force caused by the movement of the blocking segment when the base frame is rocked upward and downward.

BRIEF DESCRIPTION OF THE DRAWINGS

The above objects and the features of the present invention will be made more apparent by describing a preferred embodiment of the present invention with reference to the accompanying drawings, in which.

DESCRIPTION OF THE PREFERRED EMBODIMENT

Figure 1:
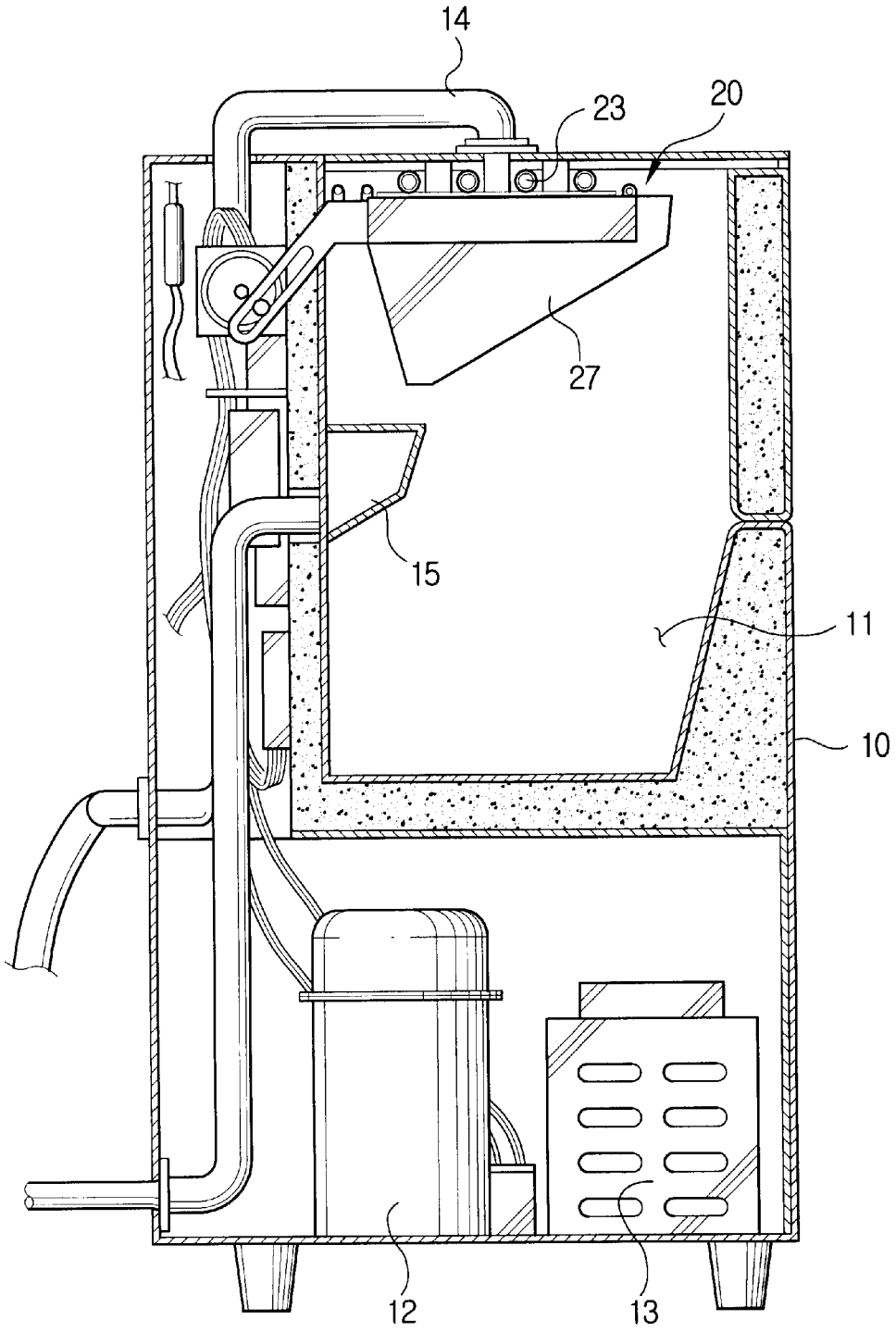
FIG. 1 (PRIOR ART)
FIG. 1 is a cross-sectional view showing a conventional ice-making machine.
Figure 2:
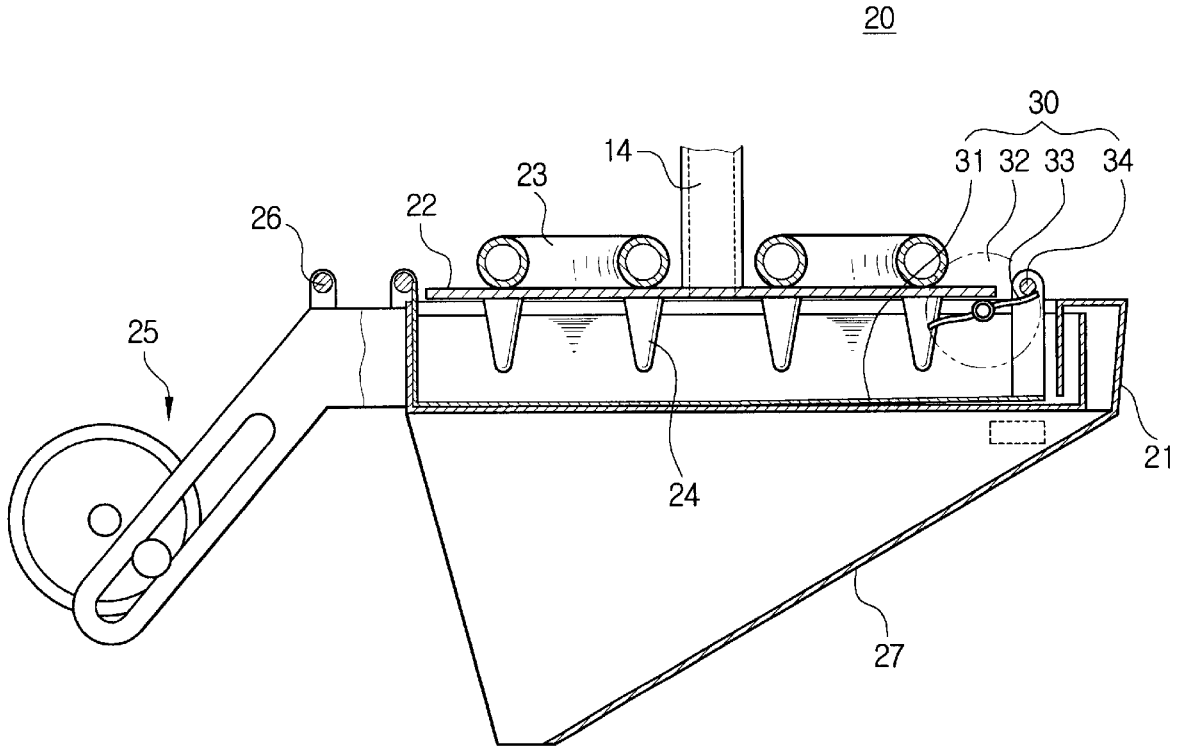
FIG.2 (PRIOR ART)
FIG. 2 is a cross-sectional, side section view showing a main part of the conventional ice-making machine shown in FIG. 1.
Figure 3:
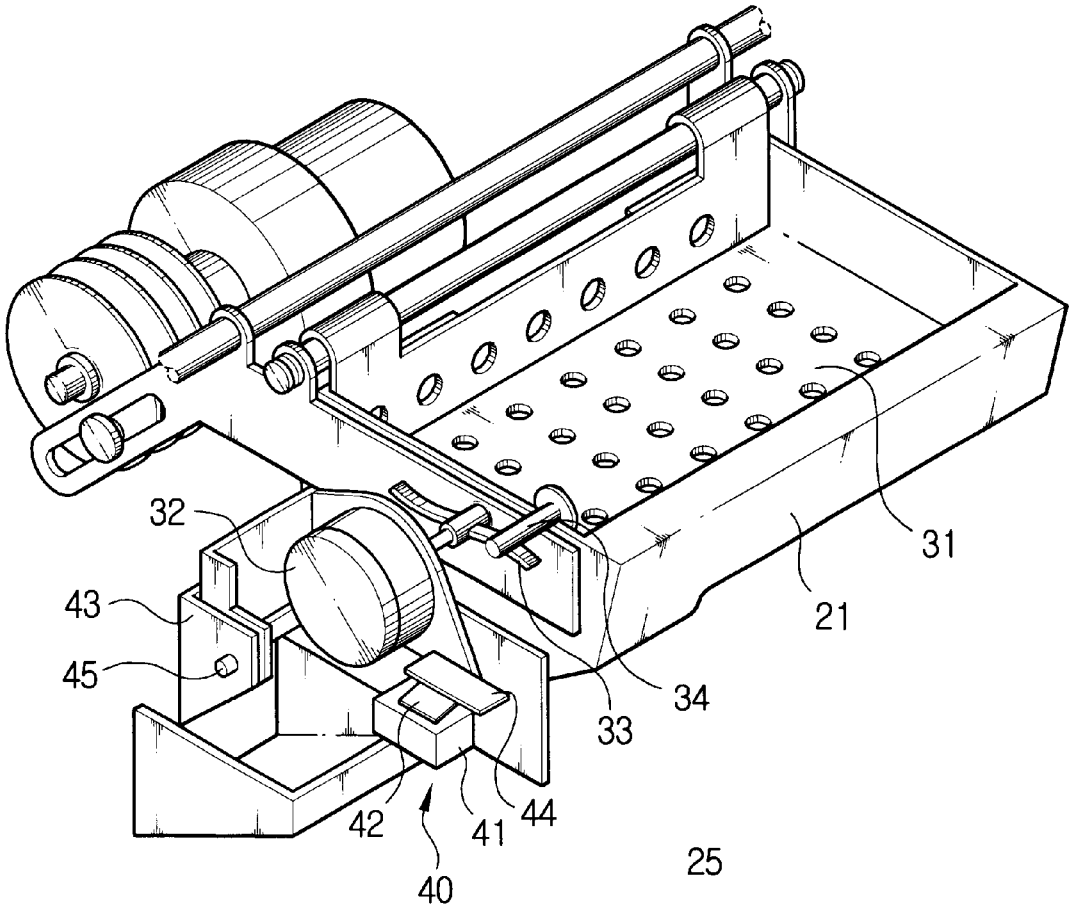
FIG.3 (PRIOR ART)
FIG. 3 is a perspective view showing the part shown in FIG. 2.

Hereinafter, an ice-making machine according to a preferred embodiment of the present invention will be described in greater detail with reference to the accompanying drawings. Those elements having an identical structure and function to those of the prior art ice-making machines will have like reference numerals assigned thereto.

Figure 4:
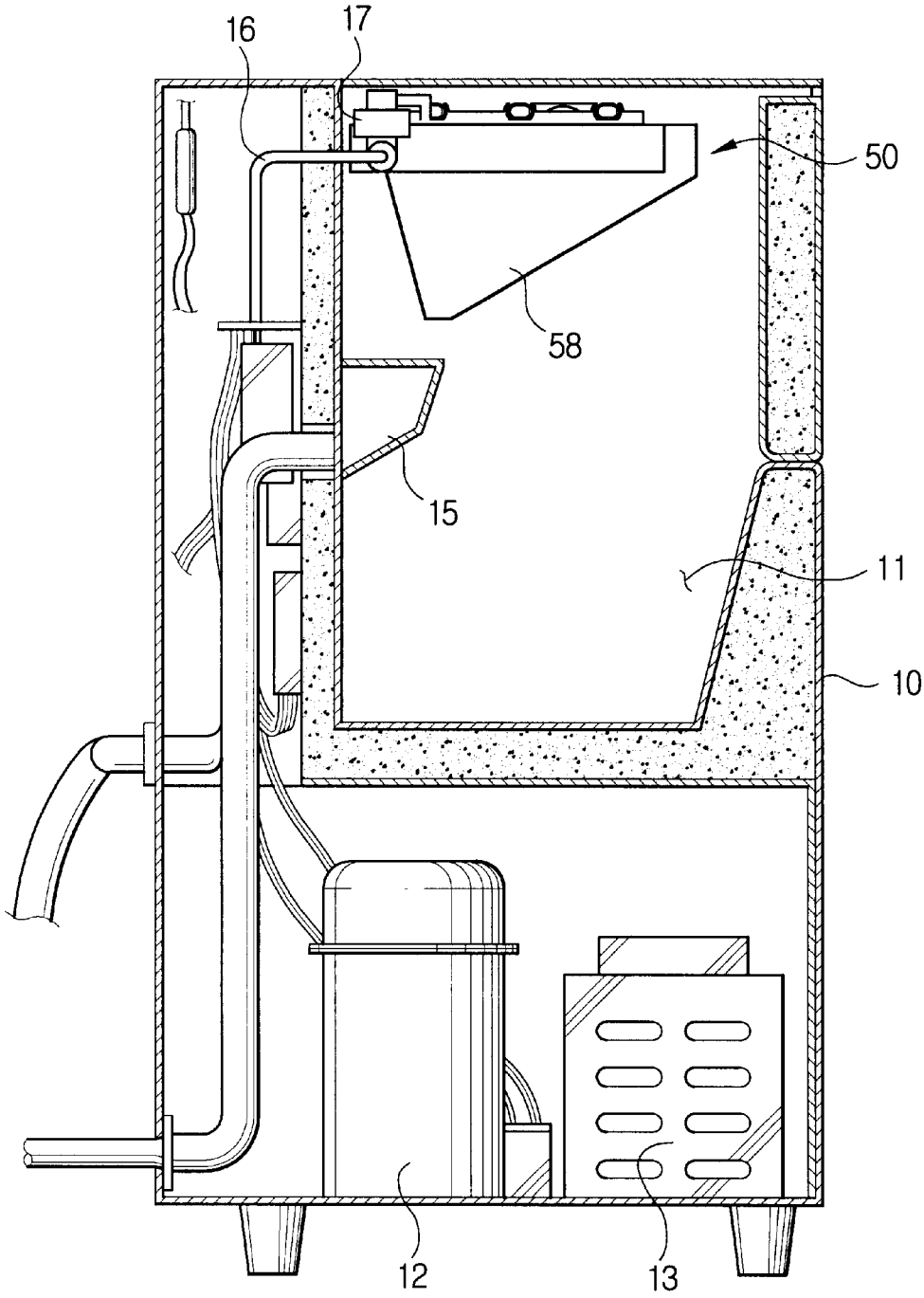
FIG. 4 is a cross-sectional view showing an ice-making machine according to a preferred embodiment of the present invention.
Figure 5:
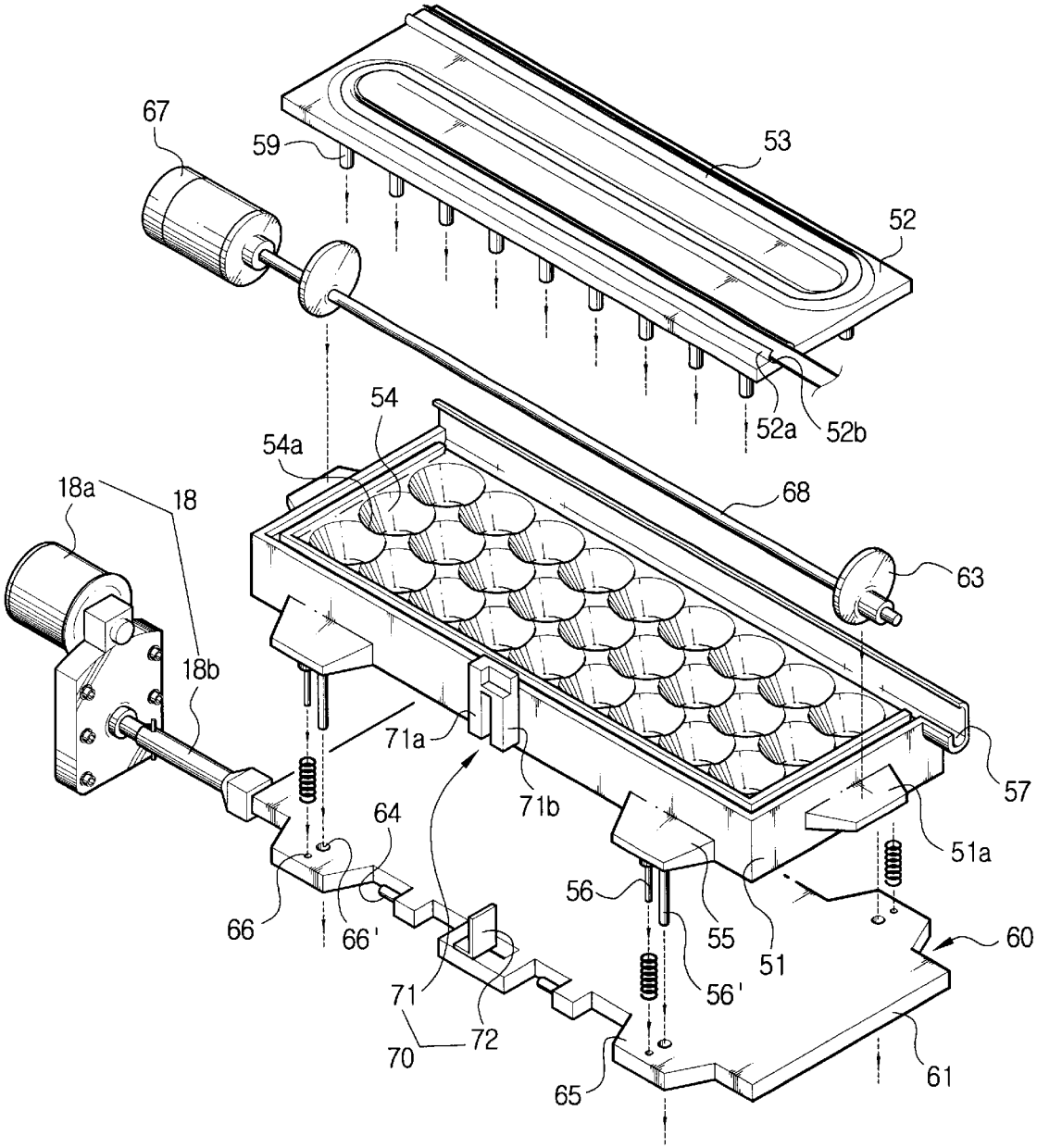
FIG. 5 is an exploded, perspective view showing the main part shown in FIG. 4.

As shown in FIGS. 4 and 5, the ice-making machine according to a preferred embodiment of the present invention includes a housing 10, a freezing unit 50, an air removing means 60, and a detecting means 70 for detecting completion of the ice forming operation.

The housing 10 has an ice bin 11 for storing ice pieces formed by the freezing unit 50. Under the ice bin 11 are disposed a compressor 12 and a condenser 13 constituting a freezing system. At one side of the ice bin 11 is provided a water collecting section 15 for collecting unfrozen water therein.

The freezing unit 50 includes a base frame 51, a freezing base plate 52, and an evaporator 53. The base frame 51 has a plurality of freezing cells 54 for filling with water to be frozen. At both sides of the base frame 51 are provided with a pair of flanges 55. First and second sliding bars 56 and 56' are disposed on a lower surface of each flange 55.

Each of the freezing cells 54 is in the shape of an inverted dome, the diameter of which becomes gradually smaller toward the lower end, and each of the freezing cells 54 are defined by the upper surface of the base frame 51. The number of the freezing cells 54 may range from 20 to 30, and preferably numbers 27, but it is subject to change depending on the freezing capacity of the freezing system.

Each freezing cell 54 is joined with the adjacent freezing cells 54, and a connecting groove 54*a* is formed in the joining areas of the neighboring freezing cells 54, for serving as a flow-path of the water between cells when the water level is above the level of the grooves 54*a*. When the water to be frozen is supplied through a water supply control valve 17 connected to a water supply pipe 16, the water is filled in one of the freezing cells 54 and then flows over the connecting grooves 54*a* into adjacent freezing cells 54. The water supply control valve 17 regulates the water supply so that the water is supplied only to the extent of the amount of water that can be contained by the freezing cells 54. Accordingly, each freezing cell 54 is filled with a predetermined amount of the water to be frozen.

In a side of the base frame 51 a drain path 57 is provided. When the base frame 51 is pivoted by a pivoting means 18 to reach a predetermined angle relative to horizontal, the unfrozen water in the freezing cells 54 is guided along the drain path 57 into a water chute 58 and then is discharged to a water collecting section 15. The pivoting means 18 includes a motor 18*a* and a pivoting shaft 18*b* disposed at and connected to a side of a supporting frame 61. The driving force of the motor 18*a* is transferred to the shaft 18*b* so that the supporting frame 61 is rotated on a pivotal shaft 64 to approximately 90° relative to horizontal.

The freezing base plate 52 has a groove 52*a* into which the evaporator 53 is inserted, and further has a cover member 52*b*. The evaporator 53 is inserted into the groove 52*a* and then is pressed by the cover member 52*b*, thereby being buried under the upper surface of the freezing base plate 52. Accordingly, a quantity of heat is removed by the evaporator 53 as it is absorbed from the freezing base plate 52.

A plurality of freezing fingers 59 are formed on a lower surface of the freezing base plate 52 that are shaped and dimensioned to be dipped into the water in one in each of the freezing cells 54. The evaporator 53 is connected to the freezing system 12,13 to allow refrigerant to flow therethrough. The freezing fingers 59 are cooled to a temperature of 0° C. or lower by heat exchange of the refrigerants flowing inside the evaporator 53, and the ice pieces gradually grow around the freezing fingers 59.

The air removing means 60 rocks the base frame 51 to float air bubbles entrained in the water upwardly and outside the water and thus removes them. The air removing means 60 includes the supporting frame 61, a spring 62 and a cam 63. The supporting frame 61 is disposed on the housing 10 and pivots on the pivotal shaft 64, for movably supporting the base frame 51 to rock vertically. At both sides of the supporting frame 61 are provided a pair of flanges 65 corresponding to the flanges 55 of the base frame 51. First and second sliding holes 66 and 66' are defined in each flange 65, for slidably receiving the first and the second sliding bars 56 and 56', which are inserted therein.

The first sliding bar 56 is inserted into the first sliding hole 66 with the spring 52 being disposed around the first sliding bar 56. Accordingly, due to the elastic recovering force of the spring 62, the supporting frame 61 enables the base frame 51 to be rocked vertically.

The cam 63 is disposed on a cam shaft 68 attached to the cam motor 67, and is used for rocking the base frame 51. When the cam motor 67 is driven, the cam 63 repeatedly presses a protrusion 51*a* formed on the base frame 51 to rock the base frame 51 vertically.

The detecting means 70 for detecting completion of the ice formation operation includes a magnetic sensor 71 and a blocking segment 72. The magnetic sensor 71 has two sensing portions 71*a* and 71*b* that are spaced from each other by a gap having a predetermined dimension, and is disposed at one side of the base frame 51. The blocking segment 72 is disposed on the supporting frame 61, and is used for blocking the magnetic force between the two sensing portions 71*a* and 71*b*. The magnetic sensor 71 rocks vertically together with the base frame 51 and periodically senses the magnetic force between the two sensing portions 71*a* and 71*b*. When the cam 63 is operated to the top dead center of the base frame 51, the blocking segment 72 is removed and separated from between the two sensing portions 71*a* and 71*b* so that the magnetic sensor 71 senses an initial magnetic force having a predetermine level. When the pieces of ice gradually grow around the freezing fingers 59 to a predetermined size, the ice pieces collide with the bottom wall of the freezing cells 54, thereby shortening the distance within which the base frame 51 can be rocked. Accordingly, even when the base frame 51 is positioned at the top dead center, the blocking segment 72 is positioned between the two sensing portions 71*a* and 71*b* because the solid ice does not permit the extent of the rocking to reach the previous level. At this time, the magnetic force between the two sensing portions 71*a* and 71*b* reaches a different level from that of the initial magnetic force, and the magnetic sensor 71 generates an ice formation completion signal.

Figure 6A:
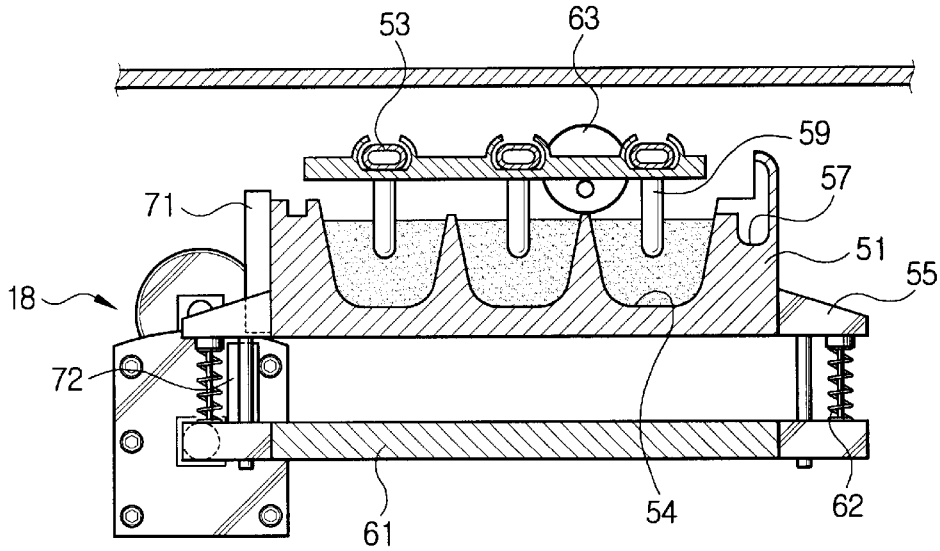
FIGS. 6A and 6B are cross-sectional views for explaining operation of an ice-making machine according to a preferred embodiment of the present invention.
Figure 6B:
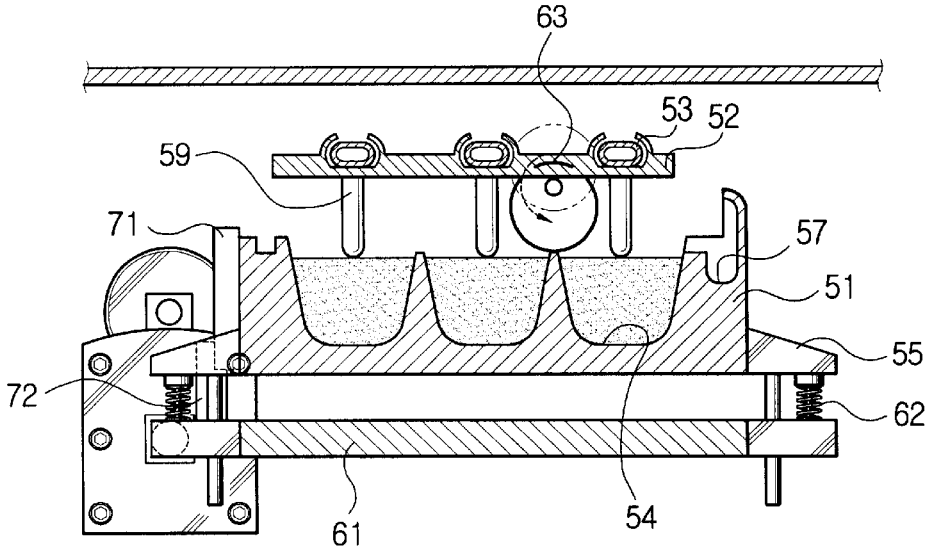
Figure 7:
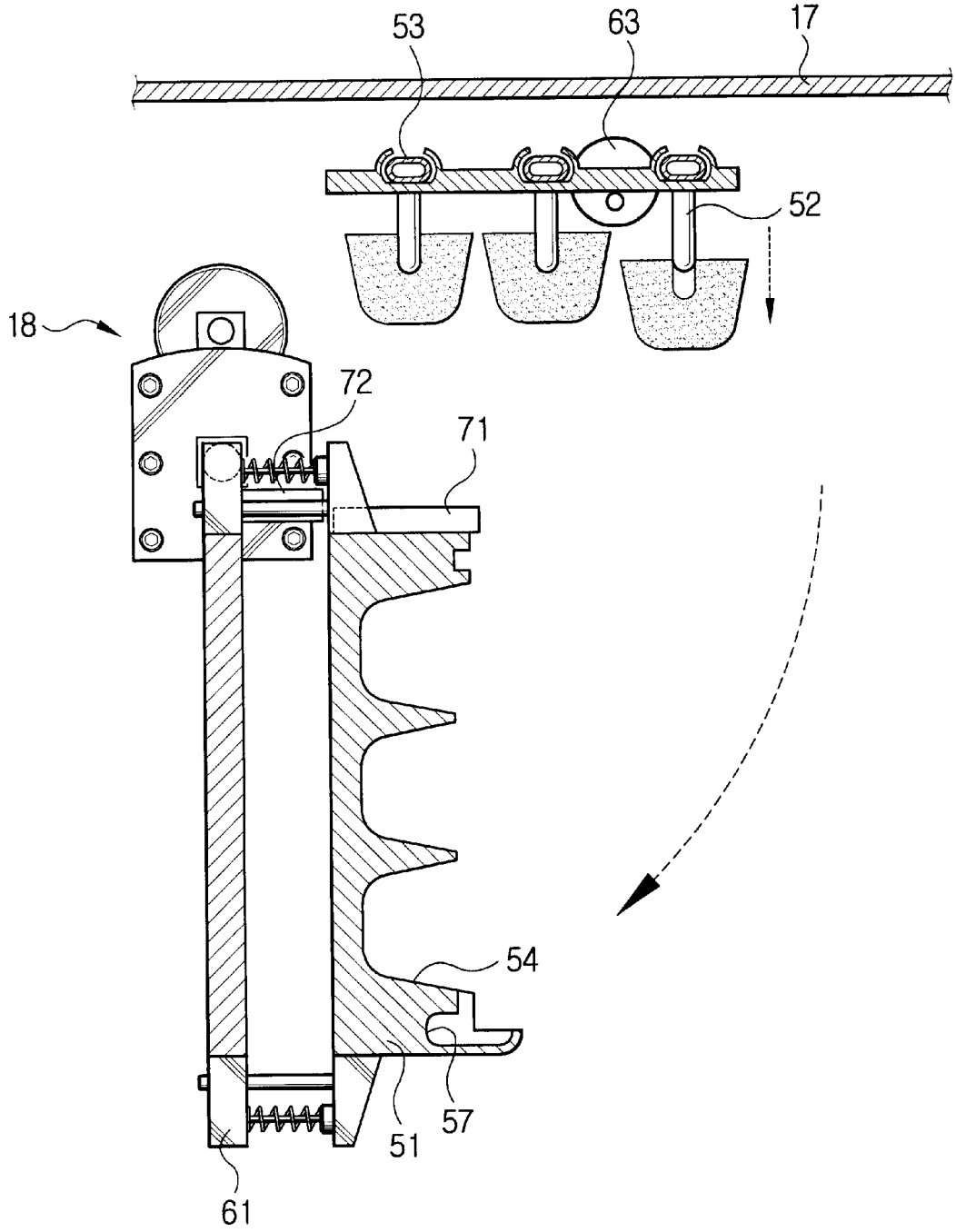
FIG. 7 is a cross-sectional view for explaining completion of the ice formation operation of an ice-making machine according to a preferred embodiment of the present invention.

Hereinbelow, the operation of the ice-making machine according to a preferred embodiment of the present invention is described with reference to FIGS. 6A through 7.

When a predetermined amount of water to be frozen is fed by the water supply control valve 17 connected to the water supply pipe 16, the water is filled in one of the freezing cells 54 that is disposed adjacent to the water supply control valve 17. After filling the first cell 54, the water then flows over the connecting groove 54*a* into the adjacent freezing cells 54. Each of the freezing cells 54 is filled with the same amount of the water, since all of the grooves 54*a* are the same level.

When the cam motor 67 is activated after the water has been supplied to all the cells 54, the cam 63 periodically presses the protrusion 51*a* of the base frame 51. The base frame 51 is vertically rocked within a predetermined distance, e.g., about 15 mm, by the pressure of the cam 63 and the elastic recovering force of the spring 62, so that the water in the freezing cells 54 is vertically rocked with respect to the freezing fingers 59. The water starts to freeze around the freezing fingers 59 that are cooled at the temperature of 0° C. or lower by the heat exchange of the refrigerant flowing inside the evaporator 53. At this time, since the air bubbles on the frozen surfaces of the freezing fingers 59 are removed due to the rocking movement of the water, clear ice pieces are formed around the freezing fingers 59.

Meanwhile, at the beginning of the operation of the ice-making machine, the base frame is positioned at the top dead center so that the blocking segment 72 is located at a distance from between the two sensing portions 71*a* and 71*b* of the magnetic sensor 71. When the ice pieces are gradually formed around the freezing fingers 59 and reach the predetermined size or more, the ice pieces collide with the bottom of the freezing cells 54, thereby shortening the distance within which the base frame 51 is rocked. Accordingly, even when the base frame 51 is positioned at the top dead center, the blocking segment 72 is positioned between the two sensing portions 71*a* and 71*b*. Because the blocking segment 72 cannot reach the space between the two sensing portions 71*a* and 71*b*, the magnetic force between the two sensing portions 71*a* and 71*b* is weaker than the initial magnetic force, and the magnetic sensor 71 senses the changed level of the magnetic force and generates a signal indicative of the completion of the ice formation.

When the magnetic sensor 71 generates the ice formation completion signal, the cam motor 67 stops being activated and the supporting frame 61 pivots on the pivotal shaft 64 by action of the pivoting means 18 to tilt the supporting frame 61 approximately 90° together with the base frame 51. At this time, the water retained in the freezing cells 54 is almost all frozen. When the base frame 51 is tilted to one side, a predetermined amount of unfrozen water is guided along the water chute 58 through the drain path 57 and then is discharged to the water collecting section 15.

Then, hot gas compressed by the compressor 12 flows directly to the evaporator 53 without being condensed by the condenser 13. Accordingly, when the freezing fingers 59 are heated to approximately 10° C., the frozen surface around the freezing fingers 59 is warmed and then the formed ice pieces are separated from the freezing fingers 59 and are dropped into the ice bin 11.

The ice-making machine according to the present invention as described above comprises the plurality of freezing cells 54 having predetermined sizes, each for receiving a predetermined amount of the water, thereby reducing the excess amount of the water supplied and later discharged. Accordingly, it is possible to install a supply tank and a drainage tank in the ice-making machine without having to install an external water supply pipe and an external drainage pipe, and thus the ice-making machine can be easily furnished regardless of equipment environments.

Moreover, according to the present invention, since the freezing fingers 59 cooled to the temperature of 0° C. or lower are dipped into the predetermined amount of the water supplied to the respective freezing cells 54, the rate of water freezing around the freezing fingers 59 is increased and thus the time required to form ice pieces and power consumption both are reduced.

The foregoing embodiments and advantages are merely exemplary and are not to be construed as limiting the present invention. The present teaching can be readily applied to other types of apparatus. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. An ice-making machine comprising:

a housing:

an evaporator connected to a freezing system;

a base frame having a plurality of freezing cells formed integrally therewith and having a predetermined size for receiving water to be frozen;

a freezing base plate on which the evaporator is disposed the freezing base plate having a lower surface and freezing fingers formed thereon to be dipped into the water received by the freezing cells; and an air-removing means for rocking the base frame to remove air bubbles from the water to be frozen.

2. An ice-making machine comprising:

a housing:

an evaporator connected to a freezing system;

a base frame having a plurality of freezing cells for receiving water to be frozen;

a freezing base plate on which the evaporator is disposed, the freezing base plate having a lower surface and freezing fingers formed thereon to be dipped into the water received by the freezing cells; and an air-removing means for rocking the base frame to remove air bubbles from the water to be frozen, wherein the air-removing means comprises:

a supporting frame for movably supporting the base frame and enabling the supporting frame to rock upward and downward;

a spring interposed between the base frame and the supporting frame; and a pressing means for repeatedly pressing the base frame; and the base frame being capable of rocking upward and downward due to the elastic recovering force of the spring and the pressure of the pressing means so that the water in the freezing cells are applied to the freezing fingers repeatedly.

3. The ice-making machine of claim 2, wherein the pressing means comprises:

a cam disposed for contact with the base frame; and a cam motor for rotating the cam.

4. The ice making machine of claim 2, wherein the base frame has a sliding bar for being inserted into a sliding hole formed in the supporting frame.

5. The ice making machine of claim 2, further comprising a detecting means for detecting the completion of the ice forming operation by detecting a variation in the distance within which the base frame is being rocked the variation depending on the sizes of the ice pieces formed around the freezing fingers.

6. The ice making machine of claim 4, wherein the detecting means comprises a magnetic sensor for sensing a variation in the magnetic force caused by the rocking base frame to detect when the ice pieces formed around the freezing fingers reach the predetermined sizes.

7. The ice making machine of claim 6, wherein a blocking segment moving vertically between both sensing portions of the magnetic sensor is movably provided at one side of the supporting frame, and the magnetic sensor is disposed at the base frame for detecting the variation in the magnetic force caused by the movement of the blocking segment when the base frame is rocked upward and downward.

* * * * *